US011655608B1

(12) United States Patent
Li et al.

(10) Patent No.: US 11,655,608 B1
(45) Date of Patent: May 23, 2023

(54) WATER STOPPING DEVICE OF SUSPENSION AND SLIDING TYPE AND AN APPLICATION THEREOF

(71) Applicant: CCCC FIRST HARBOR ENGINEERING CO., LTD., Tianjin (CN)

(72) Inventors: Zengjun Li, Tianjin (CN); Naishou Zhang, Tianjin (CN); Wei Pan, Tianjin (CN); Yiyong Li, Tianjin (CN); Qiang Wang, Tianjin (CN); Jinjin Ning, Tianjin (CN); Chuang Du, Tianjin (CN)

(73) Assignee: CCCC FIRST HARBOR ENGINEERING CO., LTD., Tianjin (CN)

( * ) Notice: Subject to any disclaimer, the term of this patent is extended or adjusted under 35 U.S.C. 154(b) by 0 days.

(21) Appl. No.: 18/076,243

(22) Filed: Dec. 6, 2022

Related U.S. Application Data

(63) Continuation of application No. PCT/CN2021/141443, filed on Dec. 27, 2021.

(51) Int. Cl.

| | |
|---|---|
| ***E02D 29/067*** | (2006.01) |
| ***E02D 29/063*** | (2006.01) |
| ***E02D 29/16*** | (2006.01) |
| *E02D 19/06* | (2006.01) |

(52) U.S. Cl.
CPC ..... *E02D 29/067* (2013.01); *E02D 29/063* (2013.01); *E02D 29/16* (2013.01); *E02D 19/06* (2013.01)

(58) Field of Classification Search
CPC ..... E02D 29/063; E02D 29/067
USPC ..... 405/136
See application file for complete search history.

(56) References Cited

U.S. PATENT DOCUMENTS 4,060,993 A * 12/1977 Shimizu ..... E02B 3/16 277/647
4,221,502 A * 9/1980 Tanikawa ..... E02D 29/16 405/126
2018/0274197 A1 9/2018 Lin

FOREIGN PATENT DOCUMENTS

| | | | | |
|---|---|---|---|---|
| CN | 107190777 A | | 9/2017 | |
| CN | 107489169 A | * | 12/2017 | ..... E02D 29/073 |
| CN | 107653910 A | | 2/2018 | |
| CN | 107700537 A | * | 2/2018 | ..... E02D 29/073 |
| CN | 107700538 A | | 2/2018 | |
| CN | 107700541 A | * | 2/2018 | ..... E02D 29/073 |

(Continued)

OTHER PUBLICATIONS

International Search Report of PCT/CN2021/141443.
Search Report of the priority application CN202111346603.3.

*Primary Examiner* — Frederick L Lagman
(74) *Attorney, Agent, or Firm* — J.C. Patents

(57) ABSTRACT

The present application provides a water stopping device of suspension and sliding type, including: a water stop; a first end thereof is connected with a first joint segment and a second end thereof is connected with a second joint segment to form a water stopping cavity; at least one first rod; a first end thereof is connected with the first joint segment and a second end thereof is movably connected with the second joint segment; and at least one first hanging structure, connected with the water stop and the corresponding first rod, and slidably provided on the corresponding first rod. The water stopping device can be applied in joint construction of an immersed tunnel.

18 Claims, 6 Drawing Sheets

(56) References Cited

FOREIGN PATENT DOCUMENTS

| | | | |
|---|---|---|---|
| CN | 108240001 | A | 7/2018 |
| CN | 108385728 | A | 8/2018 |
| CN | 208363140 | U | 1/2019 |
| CN | 209854769 | U | 12/2019 |
| CN | 113309146 | A | 8/2021 |
| JP | 9-203060 | A | 8/1997 |

* cited by examiner

4_Water stopping cavity

WATER STOPPING DEVICE OF SUSPENSION AND SLIDING TYPE AND AN APPLICATION THEREOF

CROSS-REFERENCE TO RELATED APPLICATIONS

The present application is a continuation of international application No. PCT/CN2021/141443, filed on Dec. 27, 2021, which claims the priority benefit of Chinese application No. 202111346603.3, filed on Nov. 15, 2021, entitled "water stopping device of suspension and sliding type and an application thereof" and Chinese application No. 202111347608.8, filed on Nov. 15, 2021, entitled "annular water stop construction method", the entirety of the above identified applications is hereby incorporated by reference.

TECHNICAL FIELD

The present application belongs to the technical field of cross-sea tunnel construction technology, and in particular relates to a water stopping device of suspension and sliding type and an application thereof.

BACKGROUND OF THE PRESENT INVENTION

Closure joint construction of submarine immersed tunnel projects is a key process of the overall immersed tunnel construction and is also the last segment for the tunnel closure and whole through, and its installation accuracy and water stopping effect will directly affect the success of the entire immersed tunnel construction. The closure joint construction of an immersed tunnel with push-out segment is applied for the first time in China, and there is no previous experience available for the construction of water stopping devices. In the stretching motion of a push-out segment, the water stopping devices in between the push-out segment and an enlarged segment should move synchronously with the push-out segment, and the water stopping effect of the water stopping devices should be ensured during and after the construction.

However, the closure joint construction is carried out underwater in poor operating conditions and harsh environment. If a water stop of the water stopping device is directly wrapped on the surface of the push-out segment, it will cling to the surface of the push-out segment under the action of hydraulic pressure difference, which will hinder the stretching motion of the water stop and cause the water stop to tear in severe cases. Therefore, during construction, it is particularly important to ensure the water stopping effect of the water stopping devices in motion.

SUMMARY OF THE PRESENT INVENTION

An objective of the present application is to provide a water stopping device of suspension and sliding type, which can be applied in the joint construction of an immersed tunnel and can effectively reduce the adhesion between a water stop and a push-out joint.

According to a first aspect of the present application, a water stopping device of suspension and sliding type is provided, including:

a water stop; a first end of the water stop is connected with a first joint segment and is able to move axially with the first joint segment; and a second end of the water stop is connected with a second joint segment; so as to form a water stopping cavity;

at least one first rod; a first end of the first rod is connected with the first joint segment and is able to move with the first joint segment; and a second end of the first rod is movably connected with the second joint segment and is able to move relative to the second joint segment; and at least one first hanging structure; connected with the water stop and the corresponding first rod and being slidably provided on the corresponding first rod.

Optionally, the first rod is located outside the water stopping cavity; the water stopping device of suspension and sliding type further includes at least one second rod located in the water stopping cavity and provided on the first joint segment, and at least one second hanging structure is slidably provided on the second rod and connected with the water stop within the water stopping cavity.

Optionally, the second hanging structure is elastically connected with the water stop.

Optionally, the water stop is with an M-shaped cross section and includes flat portions and folded portions, where one folded portion is formed between every two adjacent flat portions.

Optionally, a tension rope is provided between the adjacent flat portions.

Optionally, the folded portion is provided with a support member, and the support member is preferably a curved plate fitted to the folded portion.

Optionally, the water stop is annular, and the curved plates adopt one or a combination of the following five ways:

first way, the curved plate is provided along an outer circumference of the folded portion of the water stop to form an annular support ring;

second way, the curved plate is provided along an inner circumference of the folded portion of the water stop to form an annular support ring;

third way, an elastic restraint strap is provided along an outer circumference of the folded portion of the water stop;

fourth way, multiple curved plates are spaced and arranged along an outer circumference of the folded portion of the water stop, and are disconnected at outer corners of the water stopping cavity, and an elastic restraint strap is provided at each outer corner;

fifth way, multiple curved plates are spaced and arranged along an inner circumference of the folded portion of the water stop, and are disconnected at inner corners of the water stopping cavity, and an elastic restraint strap is provided outside the water stopping cavity corresponding to each disconnection position (i.e., at each outer corner).

Optionally, the first rod is L-shaped, with a first edge connected with the first joint segment and a second edge movably connected with a limit device on the second joint segment, and the first hanging structure is provided on the second edge. Optionally, the second rod is linear; and the first joint segment is provided with a groove, and the second rod is installed in the groove.

Optionally, a first hole is axially formed at the limit device, and the second edge of the first rod runs through the first hole to move with the first joint segment. Or optionally, a second long hole is axially formed on the second edge of the first rod, the limit device is located in the second long hole, and a head is provided on the limit device for avoiding the limit device dropping out of the second long hole.

Optionally, a third hole for the first rod to run through is formed at the first hanging structure, and a first end of the first hanging structure is connected with the water stop through the support member; and a fourth hole for the second rod to run through is formed at the second hanging structure, and a first end of the second hanging structure is elastically connected with the support member installed on the water stop. Optionally, the support member is the curved plate, the first end of the first hanging structure and the first end of the second hanging structure are connected with an outer surface of the corresponding curved plate respectively, and an inner surface of the curved plate is connected with the folded portion of the water stop. Optionally, the first hanging structure is integrated with or rigidly connected with the curved plate.

Optionally, a plurality of the first rods are spaced and arranged at least on an upper surface of the first joint segment, and a plurality of the first hanging structures are spaced and arranged on the same first rod; a plurality of the second rods are spaced and arranged at the bottom of the first joint segment, and a plurality of the second hanging structures are spaced and arranged on the same second rod; and each hanging structure is connected with the corresponding folded portion of the water stop.

In a second aspect of the present application, an application of a water stopping device of suspension and sliding type in the joint construction of an immersed tunnel is provided. The water stopping device of suspension and sliding type is the water stopping device described in any of the preceding embodiments.

Compared with the prior art, the beneficial effects of the present application are:

The water stopping device provided by at least one embodiment of the present application can be applied to the closure joint construction process of the push-out immersed tunnel, and can telescopically move along with the push-out segment (i.e., the first joint segment) during the stretch out and draw back process. The water stopping device can play a supporting role and is not affected by the water pressure, so as to ensure the water stop effect of the whole process in the moving state of the closure joint construction.

DETAILED DESCRIPTION OF THE PRESENT INVENTION

The technical solutions of the present application will be described in detail below in combination with specific embodiments. However, it should be understood that elements, structures and features in one embodiment may also be advantageously incorporated into other embodiments without further description.

In the description of the present application, it should be noted that terms such as "first" and "second" are used for descriptive purposes only, and cannot be understood as indicating or implying the relative importance, or implicitly indicating the number of indicated technical features. Therefore, the features defined with "first" and "second" may explicitly or implicitly include one or more of these features.

Figure 1:
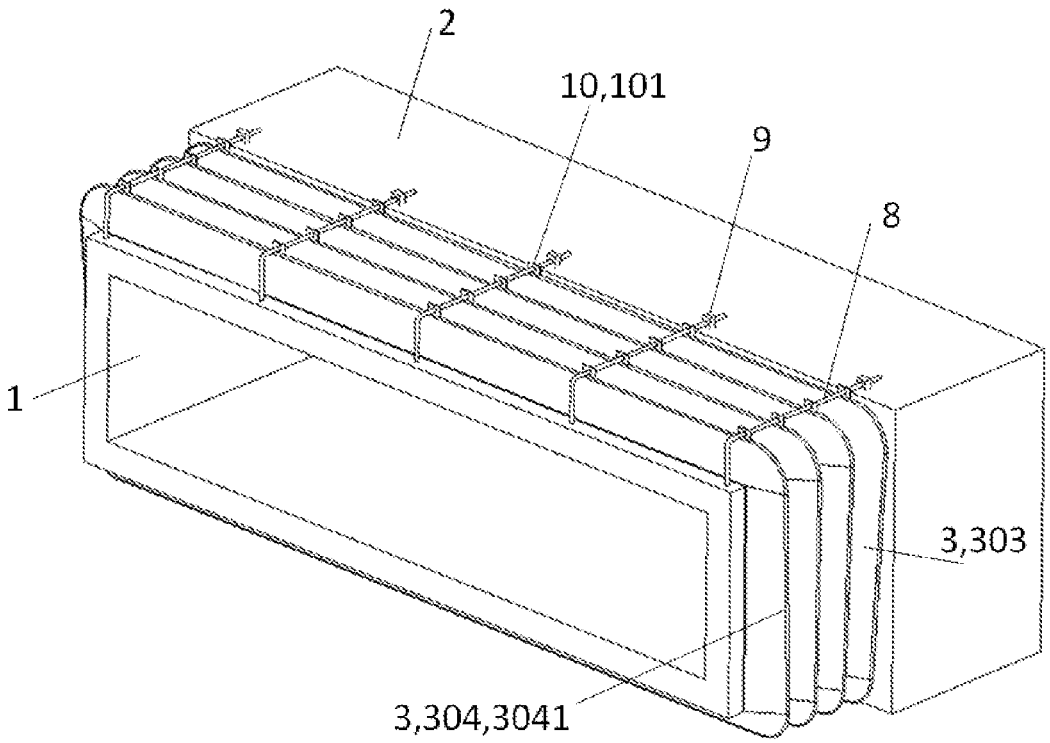
FIG. 1 is a perspective view of a water stopping device of suspension and sliding type according to one embodiment.

In the description of the present application, it should be noted that the terms "up", "down", "inner", "bottom" and the like indicate the positional or positional relationship according to the positional relationship shown in FIG. 1 merely for the convenience of describing the present application and the simplified description, but do not indicate or imply a devices or an element referred to must be of a particular orientation, constructed and operated in a particular orientation and therefore should not be construed as limiting the present application.

In the description of the present application, it should be noted that the terms "connect", "connecting" and "connected" should be understood in a broad sense unless otherwise clearly specified and limited. For example, they might be fixed connection, detachable connection, or integrated connection; might be direct connection or indirect connection through an intermediate medium, and might be internal connection of two elements. For those of ordinary skill in the art, the specific meanings of the above-mentioned terms in the present application can be understood under specific circumstances.

Figure 4:
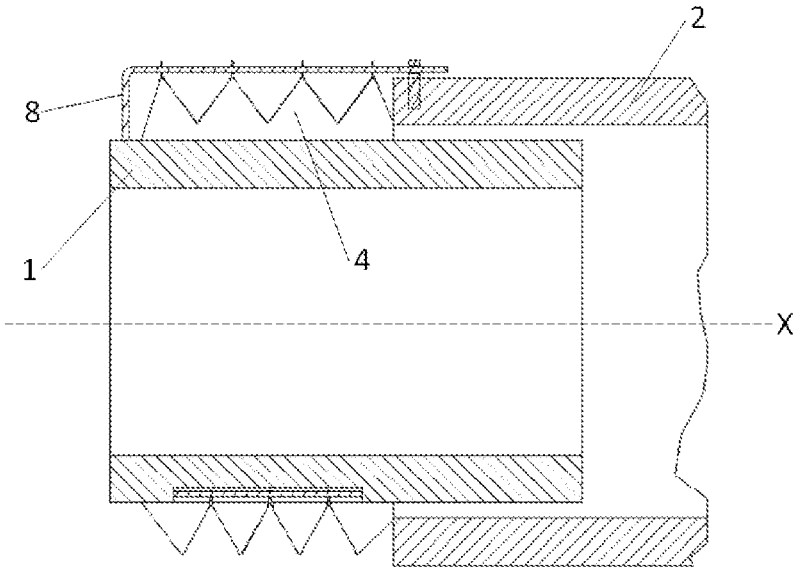
FIG. 4 is an A-A section view of FIG. 3.

A conventional immersed tunnel is provided with a first joint segment 1 and a second joint segment 2 during joint construction, wherein the first joint segment 1 is a push-out segment, which can stretch out and draw back in the axial direction X, and the second joint segment 2 is an enlarged segment relatively fixed. As shown in FIG. 4, the first joint segment 1 is partially located inside the second joint segment 2 and can move axially relative to the second joint segment 2.

In a first embodiment of the present application, a water stopping device of suspension and sliding type (hereinafter referred to as the water stopping device) is provided, which can be used for waterproofing during the joint construction of an immersed tunnel.

As shown in FIGS. 1 to 5, the water stopping device includes a water stop 3, a first end 301 of the water stop is in sealed connection with the first joint segment 1 and a second end 302 of the water stop is in sealed connection with the second joint segment 2, so as to form a water stopping cavity 4 to prevent the entry of external water. The water stop 3 may be made of rubber with certain flexibility and strength, and may also adopt an existing water stop in the prior art.

Figure 5:
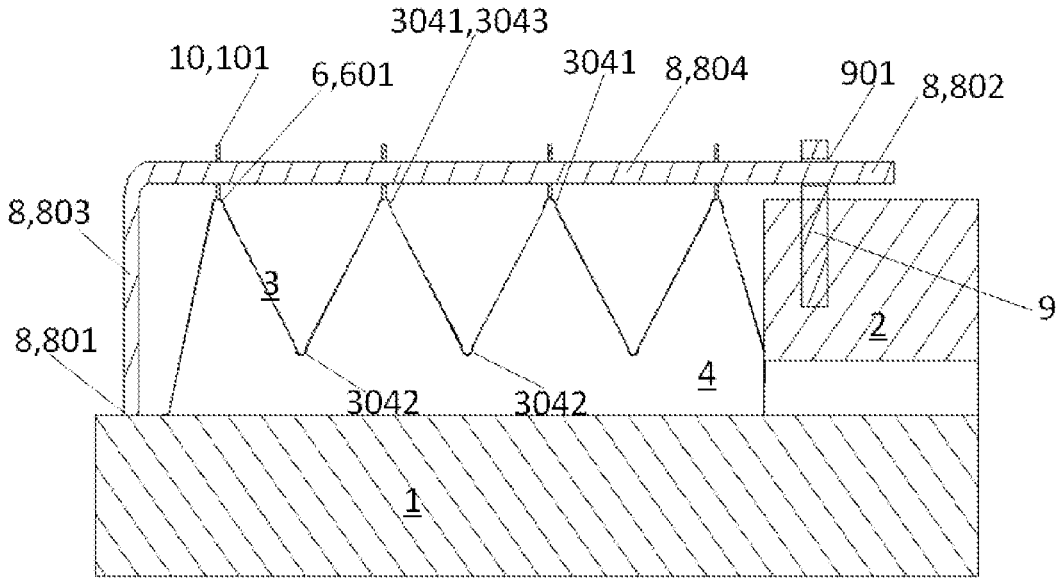
FIG. 5 is an enlarged view of an upper portion of FIG. 4.
Figure 9:
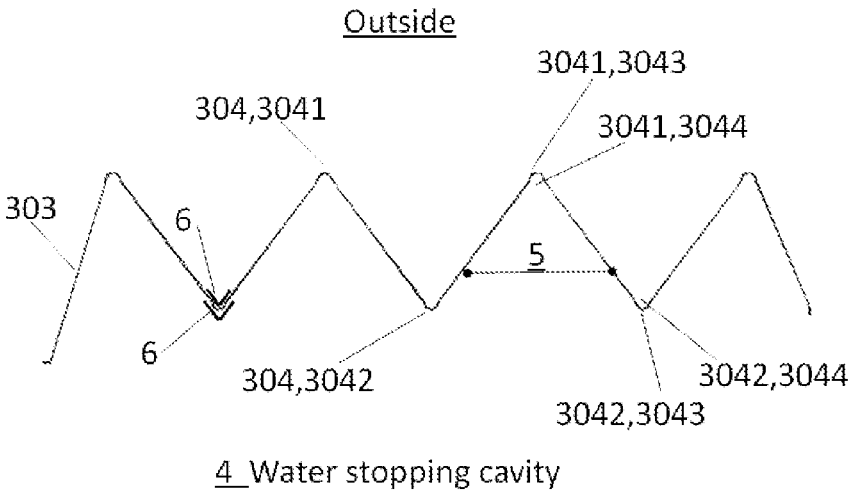
FIG. 9 is a schematic diagram of a water stop and accessories according to one embodiment.

As shown in FIGS. 1 and 5, the water stop 3 can be an annular structure arranged around the first joint segment 1, with an M-shaped cross section, so as to stretch out and draw back along with the moving of the first joint segment 1. As shown in FIG. 9, the water stop 3 includes flat portions 303 and folded portions 304, wherein one folded portion 304 is formed between every two adjacent flat portions 303 to allow the water stop 3 to stretch out and draw back. In the present embodiment, the flat portion 303 is flat relative to the folded portion 304, is not necessarily a strict flat surface, and mainly refers to a portion not folded significantly.

As shown in FIG. 9, a tension rope 5 for limiting overstretching of the water stop 3 may be provided between adjacent flat portions 303. The fixed-length tension rope is tightened as the water stop stretches, so as to limit the distance between the folded portions spaced apart and prevent the water stop from being damaged by traction due to overstretching.

Figure 7:
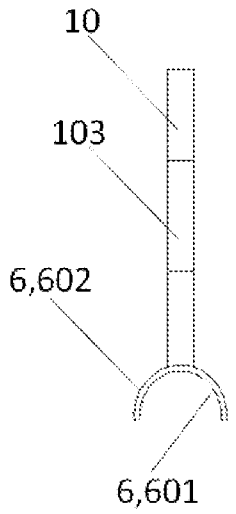
FIG. 7 is a front view of a hanging structure and a curved plate according to one embodiment.
Figure 8:
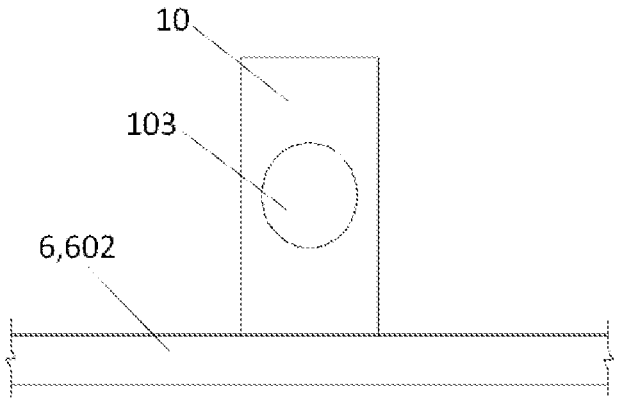
FIG. 8 is a side view of FIG. 7.
Figure 10:
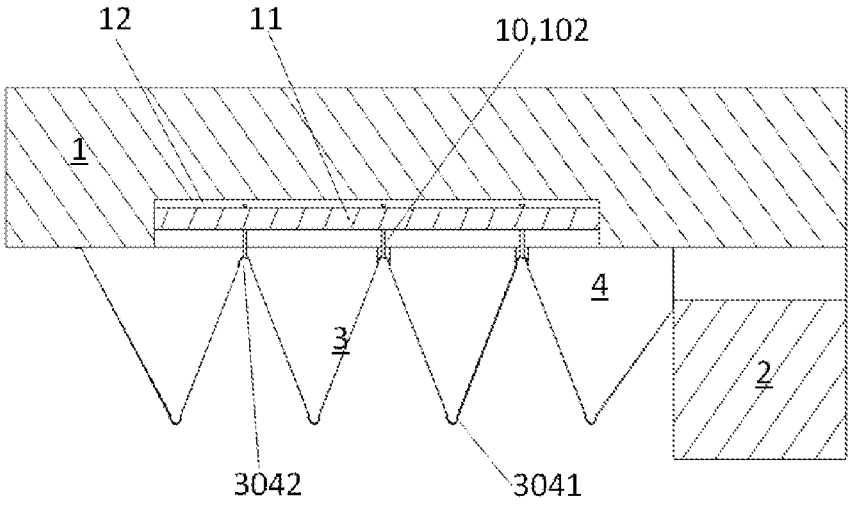
FIG. 10 is an enlarged view of a lower portion of FIG. 4.

As shown in FIGS. 5, 9 and 10, the folded portions away from the water stopping cavity 4 (or the first joint segment 1) are first folded portions 3041, and the folded portions close to the water stopping cavity 4 (or the first joint segment 1) are second folded portions 3042. Each folded portion 304 is provided with a convex portion 3043 protruding outward and a concave portion 3044 sinking inward. A support member can be provided at each folded portion 304, which may be a curved plate 6 fitted to the folded portion 304, e.g., adhered to the folded portion 304, so as to support and stabilize the water stop 3. Specifically, at the convex portion 3043 of the folded portion, an inner surface 601 of the curved plate is fitted to the convex portion 3043, while at the concave portion 3044 of the folded portion, an outer surface 602 of the curved plate is fitted to the concave portion 3044, as shown in FIGS. 7 to 9. The support members may be provided on both inner and outer sides of the same folded portion 304, and may also be provided at one of the convex portion 3043 and the concave portion 3044. The support members can enhance the support strength of the folded portions and the stability of the water stopping cavity.

Optionally, the water stop 3 is annular, and the curved plates 6 may adopt one or more ways in the following embodiments.

Figure 11:
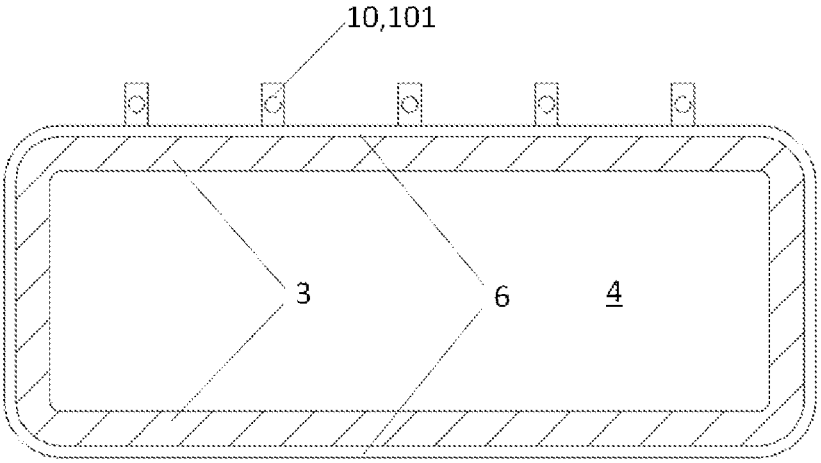
FIG. 11 is a side view of a relationship between support members and the water stop.

(1) The curved plate 6 is provided along the outer circumference of the folded portion 304 of the water stop to form an annular support ring, thereby forming an annular framework outside the water stopping cavity and greatly enhancing the support strength. This way is suitable for installing the curved plate 6 at the convex portion 3043 of the first folded portion 3041, as shown in FIGS. 9 and 11.

(2) The curved plate 6 is provided along the inner circumference of the folded portion 304 of the water stop to form an annular support ring, thereby forming an annular framework in the water stopping cavity and greatly enhancing the support strength. This way is suitable for installing the curved plate 6 at the concave portion 3044 of the first folded portions 3041.

Figure 13:
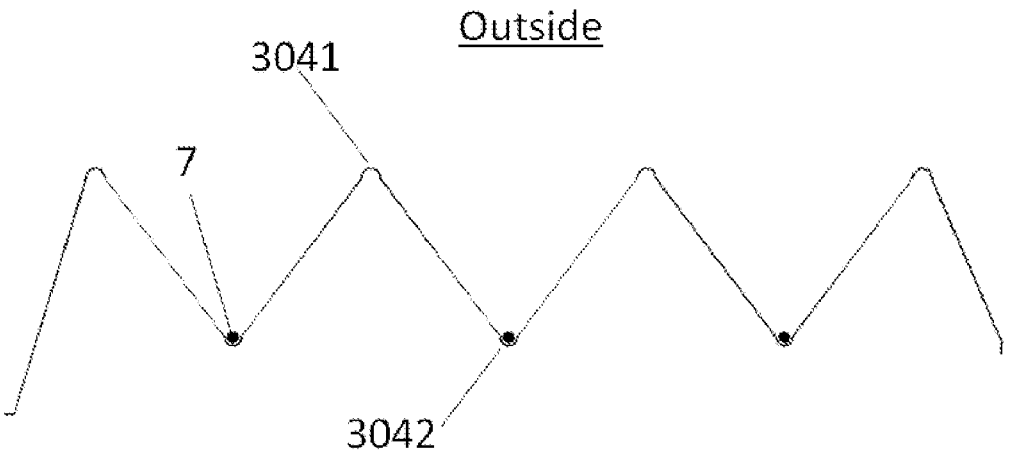
FIG. 13 is a side view of a relationship between support members and the water stop; and in which 1 first joint segment; 2 second joint segment; 3 water stop; 301 first end of water stop; 302 second end of water stop; 303 flat portion; 304 folded portion; 3041 first folded portion; 3042 second folded portion; 3043 convex portion; 3044 concave portion; 4 water stopping cavity, 5 tension rope; 6 curved plate; 601 inner surface of curved plate; 602 outer surface of curved plate; 7 restraint strap; 8 first rod; 801 first end of first rod; 802 second end of first rod; 803 first edge; 804 second edge; 8041 second long hole; 9 limit device; 901 first hole; 902 head; 10 hanging structure; 101 first hanging structure; 102 second hanging structure; 103 third hole; 11 second rod; and 12 groove.

(3) An elastic restraint strap 7 is provided along the outer circumference of the folded portion 304 of the water stop, so as to assist the water stop 3 to fold. This way is suitable for providing the restraint strap 7 around the concave portion 3044 of the second folded portion 3042, as shown in FIG. 13.

(4) A plurality of curved plates 6 are spaced along the outer circumference of the folded portion 304 of the water stop, and are disconnected at outer corners of the water stopping cavity, and the elastic restraint strap 7 is provided at each outer corner to realize elastic restraint at the corners and form an integral support structure. This way is suitable for providing the curved plates 6 and the restraint straps 7 around the concave portion 3044 of the second folded portion 3042.

Figure 12:
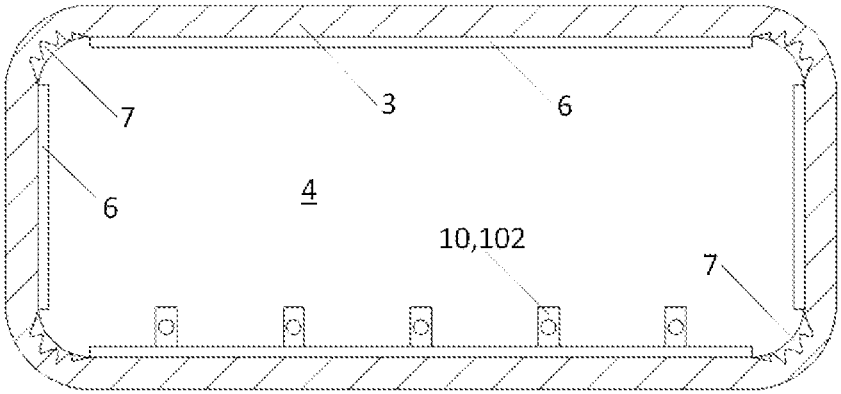
FIG. 12 is a side view of a relationship between support members and the water stop.

(5) A plurality of curved plates 6 are spaced along the inner circumference of the folded portion 304 of the water stop, and are disconnected at inner corners of the water stopping cavity, and the elastic restraint strap 7 is provided outside the water stopping cavity corresponding to each disconnection position (i.e., at each outer corner) to realize elastic restraint at the corners and form an integral support structure. This way is suitable for providing the curved plates 6 at the convex portion 3043 of the second folded portion 3042 and the restraint straps 7 at the concave portion 3044 of the second folded portion 3042, as shown in FIGS. 9 and 12.

As shown in FIGS. 1 to 5, the water stopping device further includes a first rod 8 located outside the water stopping cavity 4. One or more first hanging structures 101 are connected to the first rod 8 and the water stop 3, respectively, and are slidably arranged on the first rod 8, to allow the water stop 3 to stretch out and draw back along with the first hanging structures 101 and the first rod 8.

Figure 2:
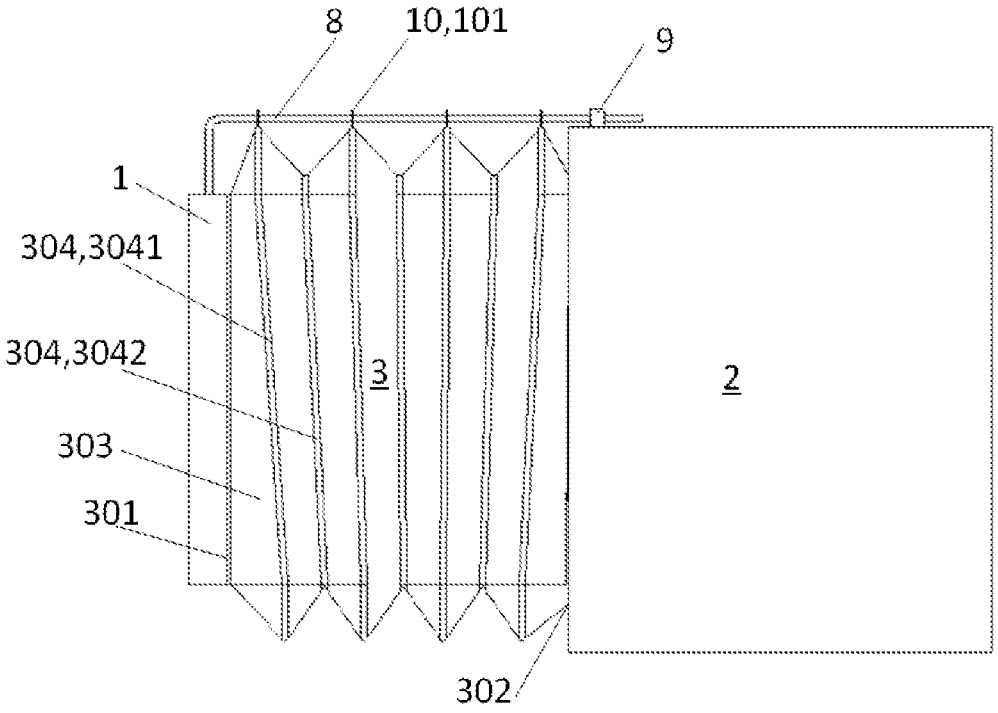
FIG. 2 is a front view of the water stopping device of suspension and sliding type.
Figure 3:
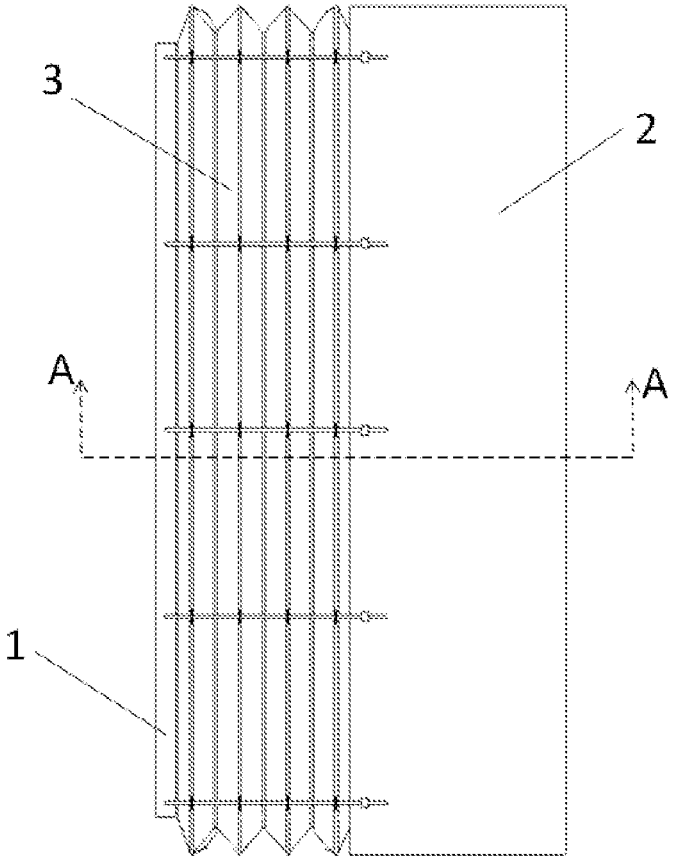
FIG. 3 is a top view of the water stopping device of suspension and sliding type.

A first end 801 of the first rod is installed on the first joint segment 1 and can move with the first joint segment 1, while a second end 802 thereof is movably installed on the second joint segment 2. Preferably, as shown in FIG. 5, the first rod 8 is L-shaped, with a first edge 803 fixedly connected to the first joint segment 1 while a second edge 804 movably connected to a limit device 9 on the second joint segment 2. In FIGS. 2 and 5, the first edge 803 is a short edge and the second edge 804 is a long edge. However, the present application is not be limited thereto.

Figure 6:
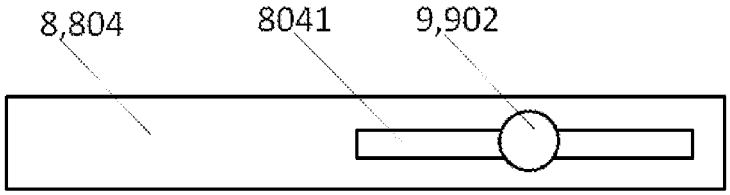
FIG. 6 is a schematic diagram of a limit device according to one embodiment.

In an optional embodiment, as shown in FIG. 5, a first hole 901 is formed at the limit device 9 along the axial direction X, the second end 802 or the second edge 804 of the first rod runs through the first hole 901 to move in the axial direction X. The first rod 8, in particular its second edge 804, may be long enough to avoid from dropping out from the first hole 901. As an alternative embodiment, as shown in FIG. 6, a second long hole 8041 is formed on the second edge 804 of the first rod along the axial direction X, which may be a rectangular hole or an elliptical hole. The limit device 9 is provided with a head 902 to confine the second long hole 8041 between the head 902 and the second joint segment 2. The second long hole 8041 moves as the water stop 3 and the first rod 8 move, but can move only in the axial direction X due to being confined by the limit device 9.

As shown in FIGS. 7 and 8, a third hole 103 through which the first rod 8 runs is formed at each first hanging structure 101, so that the first hanging structures 101 are installed on the first rod 8 through the third holes 103 and can slide on the first rod 8 along the axial direction X.

Optionally, a first end of the first hanging structure 101 is connected to the water stop 3 through the support member. Specifically, when the support member is the curved plate 6, the first end of the first hanging structure 101 can be connected to the outer surface 602 of the curved plate, and the inner surface 601 of the curved plate is connected to the first folded portion 3041 of the water stop, so that the first hanging structure 101 is connected to the first folded portion 3041 of the water stop, specifically to the convex portion 3043 of the first folded portion. Optionally, the first hanging structure 101 may also be integrated with or rigidly connected to the curved plate 6, as shown in FIGS. 7 and 8, to facilitate production and installation on the first rod 8.

Optionally, as shown in FIGS. 1 to 5, a plurality of first rods 8 are spaced arranged between the first joint segment 1 and the second joint segment 2; and preferably provided on an upper surface and side faces of the first joint segment 1. A plurality of first hanging structures 101 are spaced arranged on the same first rod 8 and connected to the corresponding folded portions (the first folded portions) respectively. In FIG. 1, five first rods 8 are spaced arranged on the upper surface of the first joint segment 1, and four first hanging structures are provided on each first rod. It can be understood that the present application is not limited thereto and that a greater or lesser number may be provided as desired. Under the combined action of the first rods 8 and the first hanging structures 101, the water stop 3 can slide in suspension, so that the water stop 3 is less likely to adhere to the surface of the first joint segment 1, and the first joint segment 1 can be stretched more freely to facilitate construction.

As shown in FIG. 10, the water stopping device further includes a second rod 11 located in the water stopping cavity 4. A groove 12 for installing the second rod 11 is provided at the bottom of the first joint segment 1. The second rod 11 can be linear, and one or more second hanging structures 102 are provided thereon. The second hanging structures can slide axially on the second rod 11 through a fourth hole of each second hanging structure 102. A first end of each second hanging structure 102 is elastically connected to the water stop 3. For example, an elastic member (not shown), such as a spring or an elastic rope, is provided between the second hanging structure 102 and the water stop 3, which can allow the second hanging structures 102 and the water stop 3 to move together and also keep the water stop folded. Specifically, the first end of the second hanging structure 102 is elastically connected to the outer surface 602 of the curved plate, and the inner surface 601 of the curved plate is connected to the second folded portion 3042 of the water stop, specifically to the convex portion 3043 of the second folded portion. Preferably, the second rod 11 is provided at the bottom of the first joint segment 1, and can support the folded water stop 3 from the inside, so as to reduce or avoid the water stop 3 from adhering to the first joint segment 1 or falling off to the waterbed. Optionally, similar to the first rod 8, a plurality of the second rods 11 can be spaced arranged, and a plurality of second hanging structures 102 respectively connected to the water stop 3 are spaced arranged on each second rod 11, so as to form a firmer bottom-supported structure.

The first hanging structure 101 and the second hanging structure 102 is of the same structure or have certain similarities, which can be collectively referred to as the hanging structure 10. In the present embodiment, the first hanging structure 101 is mainly connected outside the water stopping cavity to the first rod 8 and the water stop 3, especially to the first folded portions 3041 of the water stop, and the second hanging structure 102 is mainly connected within the water stopping cavity to the second rod 11 and the water stop 3, especially to the second folded portions 3042 of the water stop.

When the first joint segment 1 is pushed out, both the first rods 8 and the second rods 11 can move synchronously with the first joint segment 1, and the water stop 3 can slide in suspension on the first rods 8 and the second rods 11 while moving, so as to keep away from the first joint segment 1.

In a second embodiment of the present application, an application of a water stopping device of suspension and sliding type is provided, and the water stopping device can be used for waterproofing during the joint construction of immersed tunnel. The water stopping device of suspension and sliding type is the water stopping device described in any of the preceding embodiments.

The embodiments are only described as preferred embodiments of the present application, and are not intended to limit the scope of the present application. Various modifications and improvements made on the technical solutions of the present application by ordinary skill in the art without departing from the design spirit of the present application shall fall within the protective scope confirmed by the claims of the present application.

The invention claimed is:

1. A water stopping device of suspension and sliding type, the water stopping device comprising:

a water stop; a first end of the water stop is connected with a first joint segment and is able to move axially with the first joint segment; and a second end of the water stop is connected with a second joint segment; so as to form a water stopping cavity;

at least one first rod; a first end of the first rod is connected with the first joint segment and is able to move with the first joint segment; and a second end of the first rod is movably connected with the second joint segment; and at least one first hanging structure; connected with the water stop and the corresponding first rod, and slidably provided on the corresponding first rod.

2. The water stopping device of suspension and sliding type according to claim 1, wherein, the first rod is located outside the water stopping cavity; the water stopping device of suspension and sliding type further includes at least one second rod located in the water stopping cavity and provided on the first joint segment, and at least one second hanging structure is slidably provided on the second rod and is connected with the water stop within the water stopping cavity.

3. The water stopping device of suspension and sliding type according to claim 1, wherein, the water stop is with an M-shaped cross section and includes flat portions and folded portions, wherein one folded portion is formed between every two adjacent flat portions.

4. The water stopping device of suspension and sliding type according to claim 3, wherein, a tension rope is provided between adjacent flat portions; the folded portion is provided with a support member, and the support member is a curved plate fitted to the folded portion.

5. The water stopping device of suspension and sliding type according to claim 3, wherein, the folded portion is provided with a curved plate fitted to the folded portion; the water stop is annular; and the curved plates adopt one or a combination of the following five ways:

first way, the curved plate is provided along an outer circumference of the folded portion of the water stop, to form an annular support ring;

second way, the curved plate is provided along an inner circumference of the folded portion of the water stop, to form an annular support ring;

third way, an elastic restraint strap is provided along an outer circumference of the folded portion of the water stop;

fourth way, multiple curved plates are spaced and arranged along an outer circumference of the folded portion of the water stop, and are disconnected at outer corners of the water stopping cavity; and an elastic restraint strap is provided at each outer corner;

fifth way, multiple curved plates are spaced and arranged along an inner circumference of the folded portion of the water stop, and are disconnected at inner corners of the water stopping cavity; and an elastic restraint strap is provided outside the water stopping cavity corresponding to each disconnection position.

6. The water stopping device of suspension and sliding type according to claim 3, wherein, the first rod is L-shaped, with a first edge connected with the first joint segment and a second edge movably connected with a limit device on the second joint segment, and the first hanging structure is provided on the second edge.

7. The water stopping device of suspension and sliding type according to claim 6, wherein, the limit device adopts one of the following: first, a first hole is axially formed at the limit device, and the second edge of the first rod runs through the first hole; second, a second long hole is axially formed on the second edge of the first rod, the limit device is located in the second long hole, and a head is provided on the limit device for avoiding the second long hole dropping out of the limit device.

8. The water stopping device of suspension and sliding type according to claim 5, wherein, a third hole for the first rod to run through is formed at the first hanging structure, and a first end of the first hanging structure is connected with the water stop through a support member; the first end of the first hanging structure is connected with an outer surface of the corresponding curved plate respectively, and an inner surface of the curved plate is connected with the folded portion of the water stop; and the first hanging structure is integrated with or rigidly connected with the curved plate.

9. The water stopping device of suspension and sliding type according to claim 5, wherein, a plurality of the first rods are spaced and arranged at least on an upper surface of the first joint segment, and a plurality of the first hanging structures are spaced and arranged on the same first rod; and each hanging structure is connected with the corresponding folded portion of the water stop.

10. The water stopping device of suspension and sliding type according to claim 7, wherein, a plurality of the first rods are spaced and arranged at least on an upper surface of the first joint segment, and a plurality of the first hanging structures are spaced and arranged on the same first rod; and each hanging structure is connected with the corresponding folded portion of the water stop.

11. The water stopping device of suspension and sliding type according to claim 2, wherein, the water stop is with an M-shaped cross section and includes flat portions and folded portions, wherein one folded portion is formed between every two adjacent flat portions; the folded portion is provided with a support member, and the support member is a curved plate fitted to the folded portion.

12. The water stopping device of suspension and sliding type according to claim 11, wherein, the water stop is annular; and the curved plates adopt one or a combination of the following five ways:

first way, the curved plate is provided along an outer circumference of the folded portion of the water stop, to form an annular support ring;

second way, the curved plate is provided along an inner circumference of the folded portion of the water stop, to form an annular support ring;

third way, an elastic restraint strap is provided along an outer circumference of the folded portion of the water stop;

fourth way, multiple curved plates are spaced and arranged along an outer circumference of the folded portion of the water stop, and are disconnected at outer corners of the water stopping cavity; and an elastic restraint strap is provided at each outer corner;

fifth way, multiple curved plates are spaced and arranged along an inner circumference of the folded portion of the water stop, and are disconnected at inner corners of the water stopping cavity; and an elastic restraint strap is provided outside the water stopping cavity corresponding to each disconnection position.

13. The water stopping device of suspension and sliding type according to claim 2, wherein, the first rod is L-shaped, with a first edge connected with the first joint segment and a second edge movably connected with a limit device on the second joint segment, and the first hanging structure is provided on the second edge; the second rod is linear; the first joint segment is provided with a groove, and the second rod is installed in the groove; and the second hanging structure is elastically connected with the water stop.

14. The water stopping device of suspension and sliding type according to claim 13, wherein, the limit device adopts one of the following: first, a first hole is axially formed at the limit device, and the second edge of the first rod runs through the first hole; second, a second long hole is axially formed on the second edge of the first rod, the limit device is located in the second long hole, and a head is provided on the limit device for avoiding the second long hole dropping out of the limit device.

15. The water stopping device of suspension and sliding type according to claim 11, wherein, a third hole for the first rod to run through is formed at the first hanging structure, and a first end of the first hanging structure is connected with the water stop through a support member; a fourth hole for the second rod to run through is formed at the second hanging structure, and a first end of the second hanging structure is elastically connected with a support member installed on the water stop; the first end of the first hanging structure and the first end of the second hanging structure are connected with an outer surface of the corresponding curved plate respectively, and an inner surface of the curved plate is connected with the folded portion of the water stop; and the first hanging structure is integrated with or rigidly connected with the curved plate.

16. The water stopping device of suspension and sliding type according to claim 11, wherein, a plurality of the first rods are spaced and arranged at least on an upper surface of the first joint segment, and a plurality of the first hanging structures are spaced and arranged on the same first rod; a plurality of the second rods are spaced and arranged at the bottom of the first joint segment, and a plurality of the second hanging structures are spaced and arranged on the same second rod; and each hanging structure is connected with the corresponding folded portion of the water stop.

17. The water stopping device of suspension and sliding type according to claim 12, wherein, a plurality of the first rods are spaced and arranged at least on an upper surface of the first joint segment, and a plurality of the first hanging structures are spaced and arranged on the same first rod; a plurality of the second rods are spaced and arranged at the bottom of the first joint segment, and a plurality of the second hanging structures are spaced and arranged on the same second rod; and each hanging structure is connected with the corresponding folded portion of the water stop.

18. An application of the water stopping device of suspension and sliding type according to claim 1 in joint construction of an immersed tunnel.

* * * * *